US006733095B1

(12) United States Patent
Rieb

(10) Patent No.: US 6,733,095 B1
(45) Date of Patent: May 11, 2004

(54) COMPARTMENTED VITAMIN STORAGE ORGANIZER

(76) Inventor: Lorie E. Rieb, P.O. Box 2314, Halesite, NY (US) 11743

( * ) Notice: Subject to any disclaimer, the term of this patent is extended or adjusted under 35 U.S.C. 154(b) by 0 days.

(21) Appl. No.: 10/004,953

(22) Filed: Dec. 5, 2001

(51) Int. Cl.[7] ..... A47F 3/00

(52) U.S. Cl. ..... 312/122; 312/138.1; 312/234.4; 312/291

(58) Field of Search ..... 312/138.1, 138.2, 312/119, 122, 234, 234.4, 291, 35, 139.2, 292, 350; 211/184; 206/540, 526

(56) References Cited

U.S. PATENT DOCUMENTS

| | | | | | |
|---|---|---|---|---|---|
| 1,488,016 | A | * | 3/1924 | McGregor | 206/446 |
| 1,529,982 | A | * | 3/1925 | Bunzli | 312/216 |
| 2,237,176 | A | | 4/1941 | Dorman | |
| 2,266,857 | A | * | 12/1941 | Miner | 312/303 |
| 2,853,350 | A | | 6/1958 | Mandel | |
| 2,998,128 | A | * | 8/1961 | Larson | 206/338 |
| 3,606,506 | A | | 9/1971 | Ungaro | |
| 3,738,723 | A | | 6/1973 | Rudolph et al. | |
| 3,942,851 | A | * | 3/1976 | Kaplan | 312/120 |
| 3,973,813 | A | * | 8/1976 | Nesmith, Jr. | 312/204 |
| 4,054,343 | A | * | 10/1977 | Heyland | 312/209 |
| 4,231,626 | A | | 11/1980 | Amtmann et al. | |
| 4,640,560 | A | * | 2/1987 | Blum | 312/234.1 |
| 4,971,371 | A | * | 11/1990 | Gunderson | 292/76 |
| 5,200,891 | A | * | 4/1993 | Kehr et al. | 221/2 |
| 5,417,329 | A | | 5/1995 | Whitman | |
| 5,560,693 | A | | 10/1996 | Musser et al. | |
| 5,579,941 | A | * | 12/1996 | Romick | 220/23.86 |
| 5,603,559 | A | | 2/1997 | Yemini | |
| 5,632,417 | A | * | 5/1997 | Robbins et al. | 222/158 |
| 5,699,925 | A | | 12/1997 | Petruzzi | |
| 5,883,806 | A | | 3/1999 | Meador et al. | |
| 5,905,653 | A | * | 5/1999 | Higham et al. | 700/244 |
| 5,915,558 | A | * | 6/1999 | Girvetz | 206/534 |
| 6,348,864 | B1 | * | 2/2002 | Lin et al. | 340/570 |

FOREIGN PATENT DOCUMENTS

| | | |
|---|---|---|
| DE | 4239753 | 6/1994 |

* cited by examiner

*Primary Examiner*—Lanna Mai
*Assistant Examiner*—Jerry A. Anderson
(74) *Attorney, Agent, or Firm*—Michael I Kroll

(57) ABSTRACT

A compartmented storage organizer for vitamins and herbal supplements comprising a housing member having a plurality of recesses located on the front surface thereof and a corresponding number of like-sized bins to be slidably retained therein for storage or removed by the user to take with them for use as a pillbox and to be returned thereafter. The bins are magnetically maintained within the housing. A means for individually dispensing tablets is further included to assist the elderly and infirm when removing the contents therefrom.

15 Claims, 18 Drawing Sheets

COMPARTMENTED VITAMIN STORAGE ORGANIZER

BACKGROUND OF THE INVENTION

1. Field of the Invention

The present invention relates generally to storage bins and more specifically to a vitamin/herbal organizer having a plurality of bins within a housing. The vitamin/herbal organizer has a planar base whereby the organizer can be free standing. The organizer also has a planar rear exterior wall with at least one aperture whereby the organizer can be suspended from a fastener fixedly positioned to a structure such as a door or wall.

The present invention provides for several variations on the mounting of the bins within the housing with all of the variations being hermetically sealed when the bins are in the closed position to prevent oxidation of the contents therein.

The bins are maintained within the housing recesses by magnetic means. The rear wall of the compartment has a magnetic material that mates with an opposed magnet positioned on the interior wall of the bin housing. The magnet will provide a force used to compress the bin gasket to the frontal face of the bin housing. The amount of mating magnetic material will determine the force necessary to open the compartment.

Bin access is provided in the form of a button on the door having a flange member that engages the organizer housing. Each bin is composed of a hinge fastened door. A gasket is also provided, located between the door and the bin housing opening. The gasket provides an airtight seal when the access door is in the closed position, protecting the vitamins stored within from oxidation. Each individual bin can slide out from its respective housing, partially or removed totally, allowing the user to see within the bin and its contents therein. Above each bin is an exchangeable label housing with an indication arrow pointing to the relevant bin. A clear plastic protection plate and an information label are placed within the housing providing the user with pertinent information pertaining to the contents of the bin and the user. At the rear portion of the main housing unit, mounting hardware is provided.

The present invention provides the vitamin storage bin in various sizes, with various size bins to meet the needs of consumers.

2. Description of the Prior Art

There are other vitamin storage units designed to store vitamins. Typical of these is U.S. Pat. No. 2,237,176 issued to Dorman on Apr. 1, 1941.

Another patent was issued to Mandel on Sep. 23, 1958 as U.S. Pat. No. 2,853,350. Yet another U.S. Pat. No. 2,998,128 was issued to Larson on Aug. 29, 1961 and still yet another was issued on Sep. 20, 1971 to Ungaro as U.S. Pat. No. 3,606,506.

Another patent was issued to Rudolph et al. on Jun. 12, 1973 as U.S. Pat. No. 3,738,723. Another patent was issued to Ruggerone on Jul. 3, 1973 as U.S. Pat. No. 3,743,372. Another patent was issued to Amtmann et al. on Nov. 4, 1980 as U.S. Pat. No. 4,231,626. Another patent was issued to Whitman on May 23, 1995 as U.S. Pat. No. 5,417,329. Another patent was issued to Musser et al. on Oct. 1, 1996 as U.S. Pat. No. 5,560,693. Another patent was issued to Yemini on Feb. 18, 1997 as U.S. Pat. No. 5,603,559. Another patent was issued to Petruzzi on Dec. 23, 1997 as U.S. Pat. No. 5,699,925. Another patent was issued to Meador et al. on Mar. 16, 1999 as U.S. Pat. No. 5,883,806.

The invention relates to packing and dispensing or storage of merchandise. It is a container comprising a rectangular compartment adapted to receive a drawer and having inwardly turned flanges constituting its bottom, said container having externally turned lips disposed along the forward edge of one of its sides, the rear edge of its upper wall and rear edge of the other side, said lip at the rear edge of the upper wall being of approximately the same width as the space between the flanges at the bottom of the compartment.

The invention relates to a cabinet structure for storing articles comprising a frame having substantially flat parallel top and bottom members joined together at their ends, said top and bottom members being spaced apart and open at their sides, depending front and rear edges on said bottom member, said edges being in-turned at the lower portion thereof and constituting transverse channels open at their ends, down-turned front and rear edges on said top member constitiuting thickened transverse edges, the thickness of said thickened edges being approximately equal to the height of said channels.

The invention relates to a new and improved plastic cabinet drawer construction and has for its principal object the provision in elongated multiple compartment cabinets of drawers which are of square cross-section and designated for use interchangeably in any one of the compartments in a multi-compartment cabinet, whether the cabinet is placed in a horizontal plane, the cabinets having portions designated to interfit when stacked either way, that is, horizontally on top of one another or vertically alongside one another, as may best suit the user's needs in a home work-shop or other place.

This invention relates to a plurality of modular units fabricated from high impact strength plastic are provided with integrally formed means for enabling the various units to be securely though releasable interlocked in the construction.

A container for capsules that is formed out of an outer transparent parallelepiped-shaped enclosure open at one end and closed at another, the closed end comprising a wall having a slot therein, and of an article holding tray or drawer slidingly fitted in said enclosure, one end wall of the tray being provided with a tab.

A modular storage system designed with reference to a modular base unit having a height equal to one height module and a width equal to one width module and including at least two removable interconnectable storage units each of rectangular cross section and having a height equal to an integral number of width modules, each side wall of each storage unit carrying an integral number of interconnecting systems, the number of systems of each wall being equal to the height or width of a particular wall in height or width modules, and each interconnecting system of each unit being adapted for removable interconnection with the other unit.

A storage system for items such as screws, nuts, bolts and other hardware parts includes a cabinet and drawers in which the parts are packaged and sold. Cooperating keyways and keys on the cabinet and drawers and the lack of supporting horizontal partitions in the cabinet preclude the use of drawers that are not appropriately formed.

A storage and dispensing device having a plurality of individual storage and dispensing compartments is provided. Each compartment is provided with a slidable mating opening through a wall of the compartment for slidably mating with an extending track. The compartments are adapted to be grasped and slidably moved along the track to separate the compartments and permit access to compartments opened thereby. The compartments are slidably returned to a non-separated position in which the wall of one compartment serves as a closure element for an adjacent compartment. The track may be an upstanding vertical rod requiring upward horizontal separation of the compartments in order to gain access. A plurality of these compartments, each having a mating opening for sliding along the extending track, act cooperatively to prevent jamming or sticking of the compartments as they slide along the track together. The compartments are rotatable with respect to each other and rotatable in unison around the track. Additionally, the entire device may be suspended with a wire and rotated using the wire.

A wall mounted filing cabinet comprised of a cabinet having a plurality of openings formed through a front surface thereof. The cabinet is securable to a wall. The device contains a plurality of bins. The number of bins corresponds to the number of openings formed in the cabinet. Each of the bins is configured to be received within a corresponding opening. Each bin has a U-shaped handle secured to a front surface thereof.

A storage organizer, which includes a housing and drawers which are slidably accommodated within the housing. The drawers feature a locking mechanism connected to said front wall for immobilizing said drawer in said housing. The drawers further feature a downwardly extending protrusion which serves to slidably engage the housing and thereby reduce play between the drawer and the housing. The drawers further feature removable vertical dividers.

A portable plastic container has a tapered tongue on a lid top wall arranged for positioning within a tapered groove of a similar container bottom wall for vertically stacking a selected quantity of containers in an interlocking arrangement. Interlocking the containers permits opening of any container without the need foe rearranging and restacking. For interlocking one container to another, the bottom groove of one container is forced into the top tongue of a similar container. A snapping sound is heard as the tongue passes through a slightly smaller groove opening to its seated position within the groove, thus providing seating feedback and assurance to the user that the containers are properly interlocked.

A container for pharmaceutical items, comprising a tray having at least one compartment adapted to retrievably contain at least one pharmaceutical item, each said compartment having associated therewith a lid movable between a closed position restricting access to the associated compartment and an open position permitting access to the associated compartment, and each lid having associated therewith a mechanism responsive to control signals from a computer to permit movement between the closed and open positions. The invention also includes a system for dispensing pharmaceutical items comprising at least one support structure supporting at least one drawer, each said drawer being adapted to receive at least one of the above described containers and being movable with respect to said support structure between an open position permitting access to a given compartment of a given container and a closed position restricting access to all containers in each said drawer; and at least one said computer operable to control access to each compartment in each container. The invention also includes a method of controllably and securably dispensing pharmaceutical items comprising, storing pharmaceutical items in locations identifiable by a computer and to which access is controlled by a computer, inputting data identifying a desired pharmaceutical item, and having said computer identify a location having the desired item and issue appropriate control signals to permit access to the desired item.

SUMMARY OF THE PRESENT INVENTION

A primary object of the present invention is to provide a compartmented vitamin storage organizer for the storage of vitamins and herbal supplements.

Another object of the present invention is to provide a compartmented vitamin storage organizer that is wall mountable or is self-standing.

Yet another object of the present invention is to provide a compartmented vitamin storage organizer consisting of a plurality of individual bins, each bin composed of a hinge fastened door, and latch as means of closure.

Still yet another object of the present invention is to provide a compartmented vitamin storage organizer composed of a gasket located between the door and the bin housing opening, providing an air tight seal when the access door is in the closed position, protecting the vitamins stored within from oxidation.

Yet another object of the present invention is to provide a compartmented vitamin storage organizer having a label housing located above each bin and an arrow pointing to the relevant bin and a clear plastic plate and information label that are housed within providing pertinent information pertaining to the contents of the bin and the user.

Yet another object of the present invention is to provide a compartmented vitamin storage organizer having a wall mounting means located on the rear portion of the unit.

Additional objects of the present invention will appear as the description proceeds. The present invention overcomes the shortcomings of the prior art by providing a storage containment bin for the storage of vitamins and herbal supplements that is wall mountable or can self-stand and has a plurality of individual compartments, each compartment having a hinge fastened door and a latch as means of closure. A gasket is located between the door and the bin housing opening to provide an air tight seal when the access door is in the closed position and to protect the vitamins stored within from oxidation. The present invention includes various size bins and bin housings.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 1:
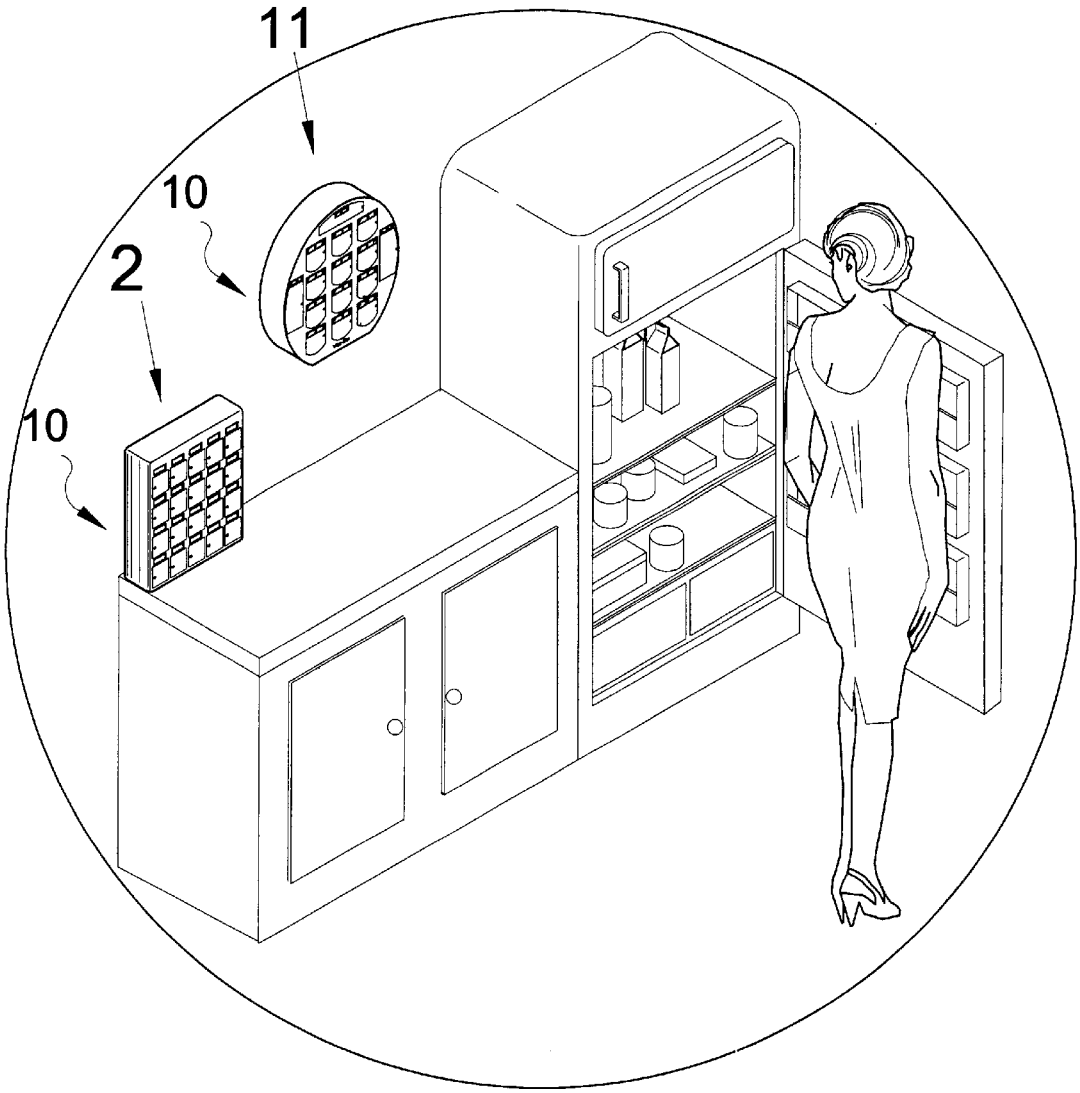
FIG. 1 is an illustrative view of the present invention in use.

LIST OF REFERENCE NUMERALS 10 compartmented storage organizer
12 organizer housing
14 modular bin
16 access door
18 door lock
20 label housing
22 hinge
24 retaining shield
26 gasket
28 vitamins
30 bin recess
32 wall fastening means
34 label
36 indicia
38 bin indication arrow
40 large bin
42 funnel shaped dispensing plate
44 tablet recess
46 dispenser element
48 transfer recess
50 bottom plate
52 first magnetic element
54 second magnetic element
56 tilt bin housing
58 rear wall of 56
60 stop member of 56
62 tilt bin pivot pin retainer
64 tilt bin
66 tilt bin pivot pin
68 tilt bin stop pin
70 spring housing
72 pressure sensitive clip
74 door clip
76 second retaining shield
78 retaining groove

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to appended claims.

Figure 2:
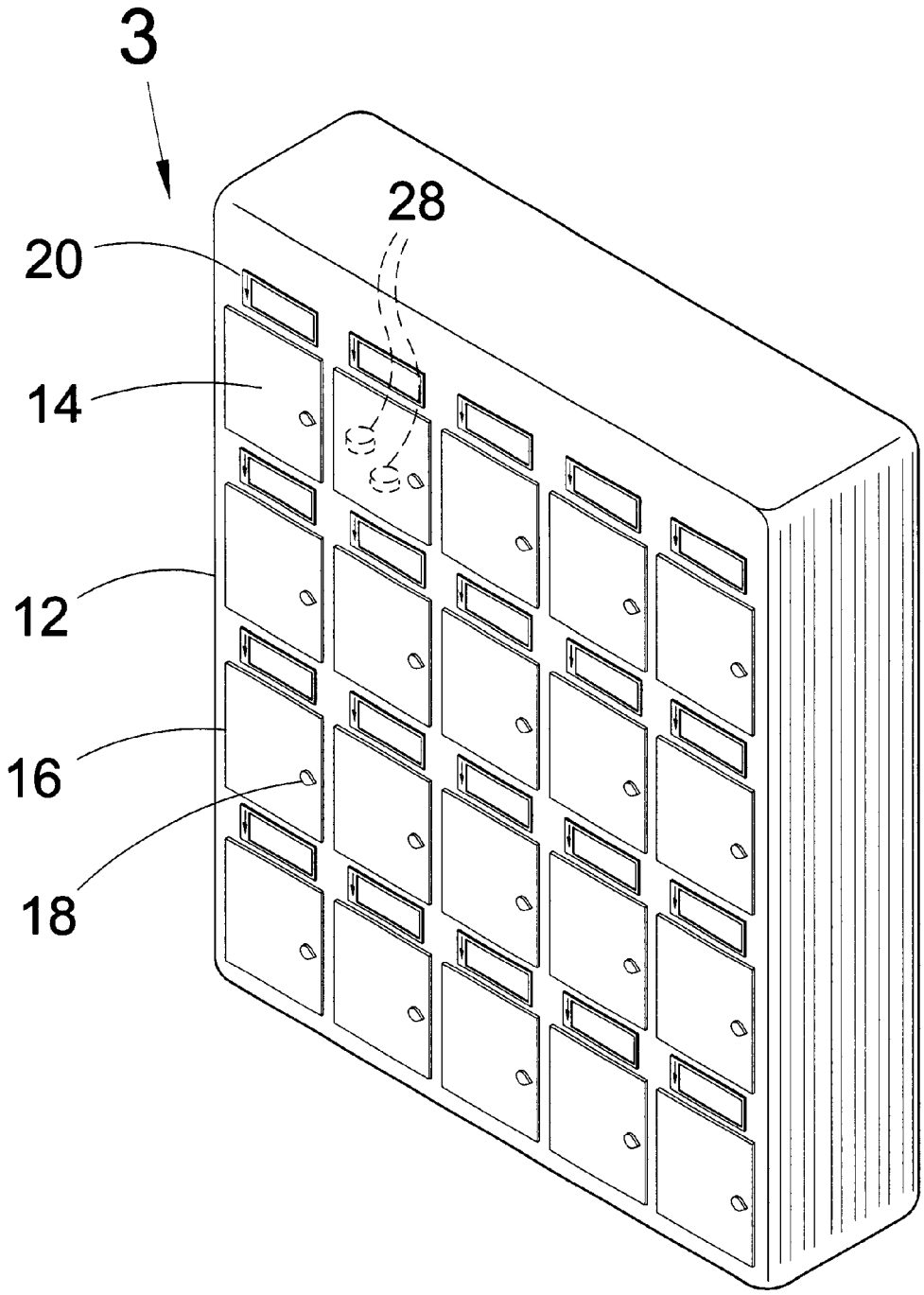
FIG. 2 is a perspective view of the present invention.

FIG. 1 is an illustrative view of the present invention 10 in use and FIG. 2 is a perspective view of the present invention 10. The present invention 10 is an organizer for vitamins and herbal supplements that could be wall mountable or free standing and comprises a bin housing 12 and a plurality of removable modular bins 14. Each bin 14 has a securable access door 16 which is hermetically sealed when closed to protect the vitamins 28 or other such contents therein from oxidation. Bins 14 can be refilled and relabeled as required. Each bin 14 is removable from the housing 12 to make them easy to clean and organize while also allowing the user to sort and individually store each days required vitamins 28, supplements and/or medication in its individual bin 14 well in advance. The compartmented vitamin storage organizer 10 is provided in various sizes to accommodate different needs and applications.

Figure 3:
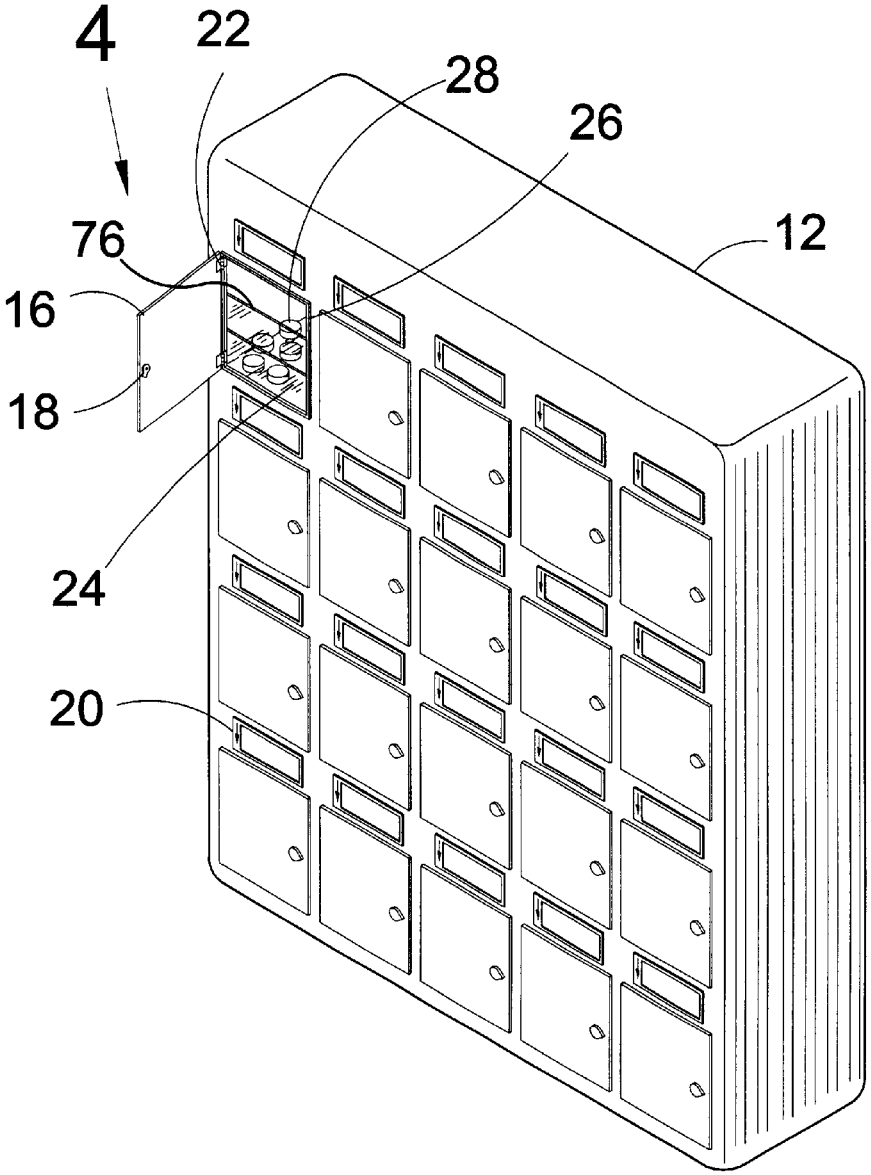
FIG. 3 is a perspective view of the present invention (with access door open).

FIG. 3 is a perspective view of the present invention 10 with the access door 16 open. Each bin has a hinged access door 16. A door latch 18 is provided as means of closure.

Figure 4:
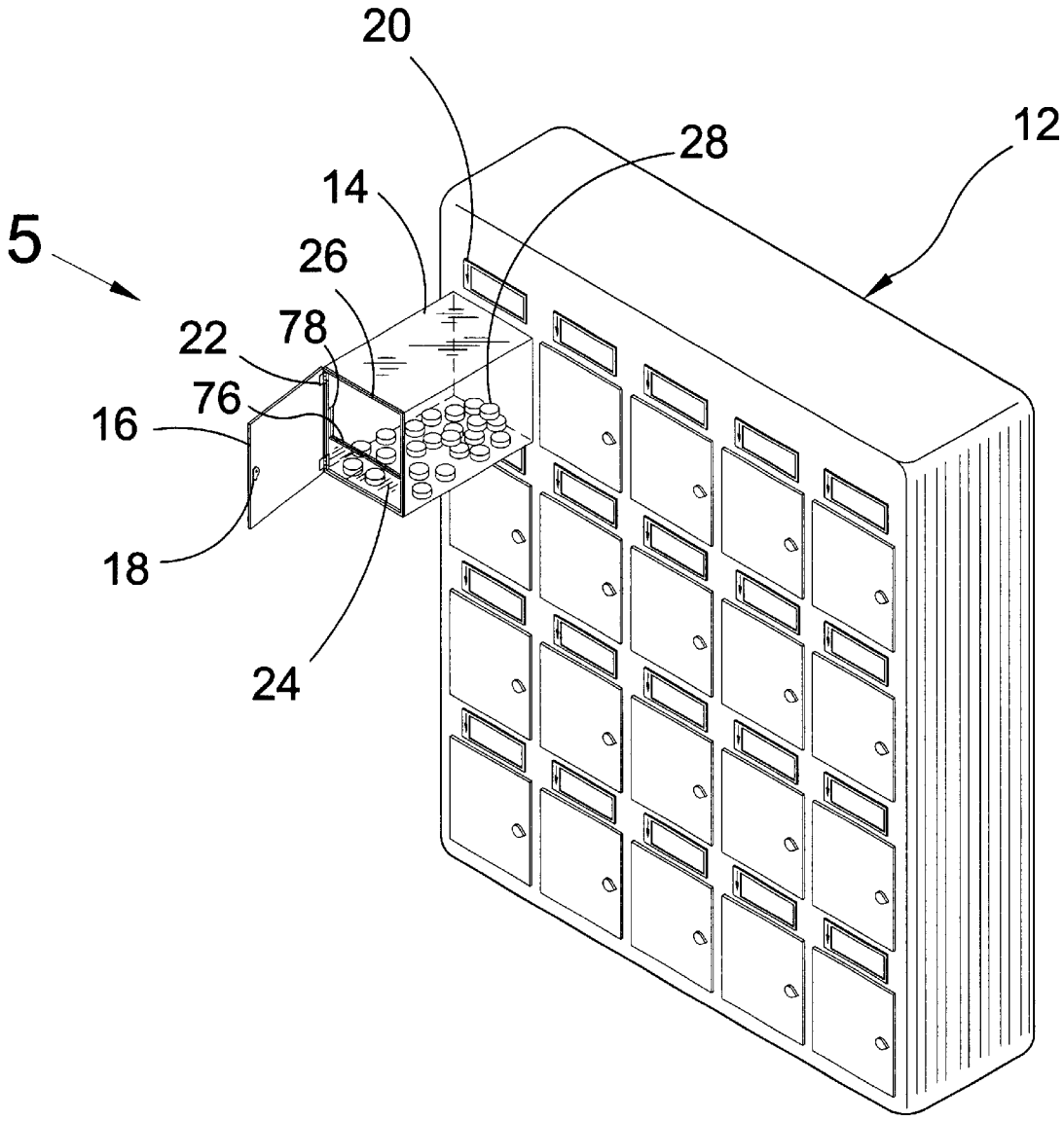
FIG. 4 is a perspective view of the present invention (with access door open and bin pulled out).
Figure 5:
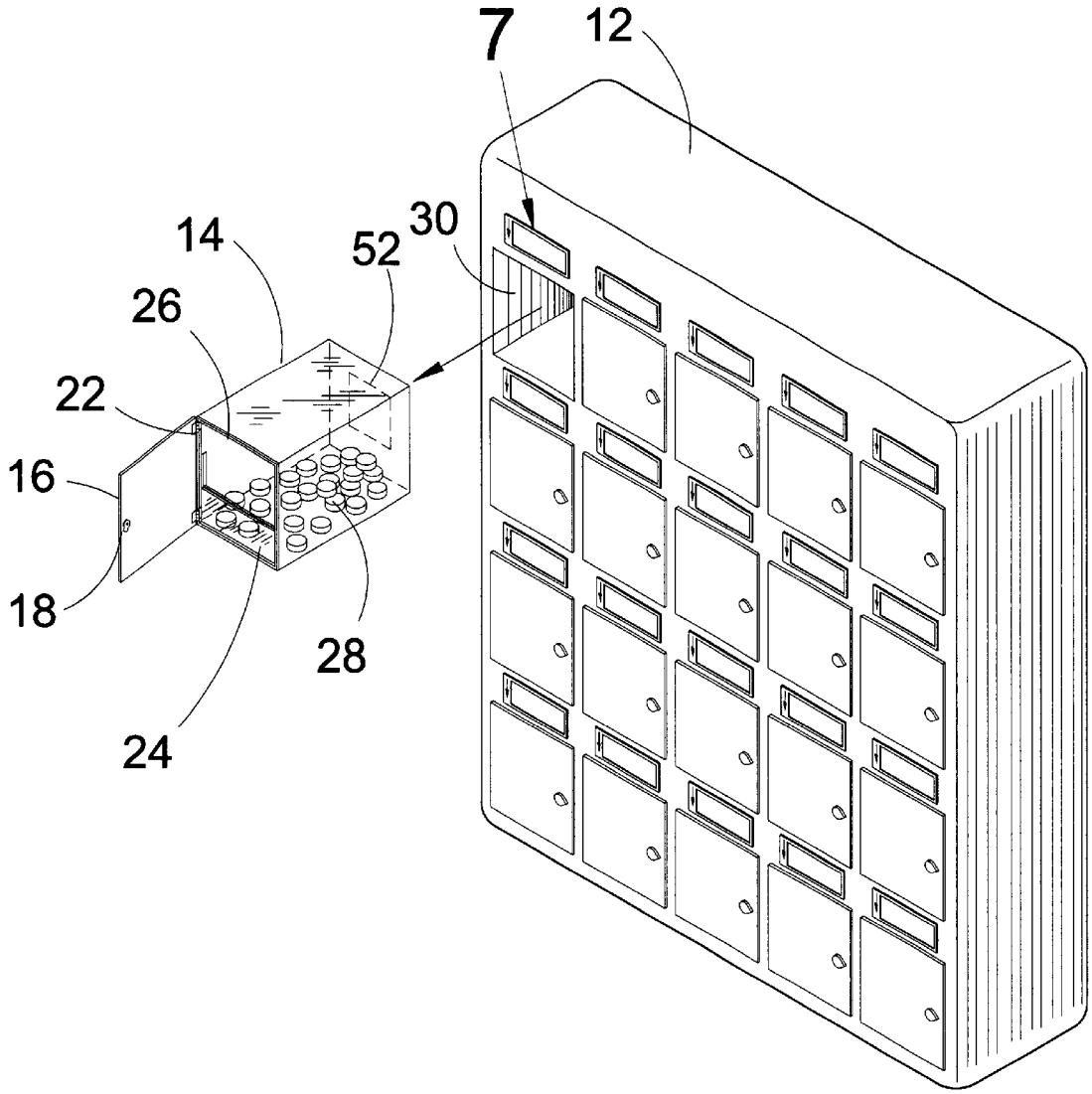
FIG. 5 is a perspective view of the present invention (with access door open and bin removed).

FIG. 4 is a perspective view of the present invention 10 with the access door 16 open and the bin 14 partially pulled out. Each individual bin 14 can slide out from the housing member 12 allowing the user to see within the bin 14 to view its contents. The bin 14 could also have the users required medication for a particular day therein and be removed completely from the housing member 12 as shown in FIG. 5 for cleaning, refilling or to be used as a pill box to be returned at a later time.

As illustrated in FIG. 4, each bin 14 has at the front open end has a pair of retaining shields 24 and 76 on a lower open portion for preventing any contents of the bin from inadvertently being removed therefrom. As also illustrated in FIG. 6, a recess 78 is provided to allow one of the shields 24 or 76 to be raised to adjust the height of the other shield to accommodate a greater or lesser amount of vitamins.

Figure 6:
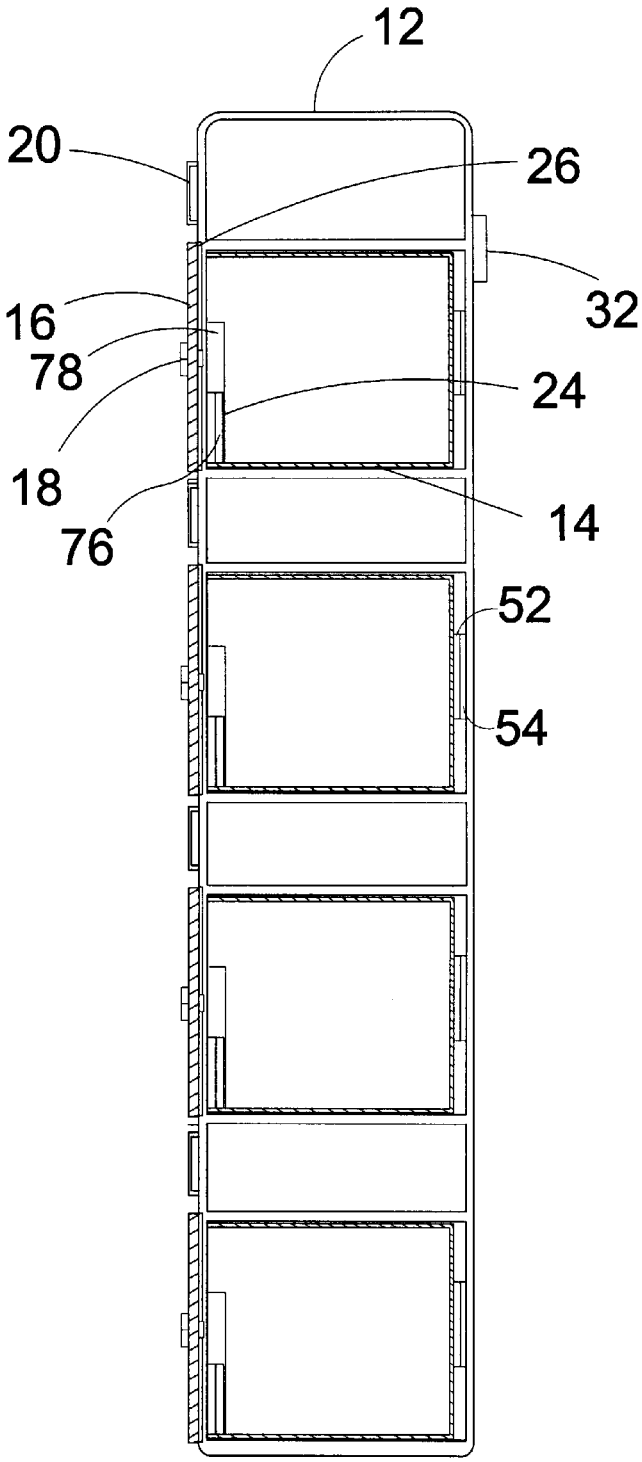
FIG. 6 is a cross sectional view of the present invention.

FIG. 6 is a cross sectional view of the present invention 10. Shown are the bin 14 inside the housing member 12. Above each bin 14 is a label housing 20 where pertinent information is provided pertaining to the contents of bin and/or the user. Positioned on the rear exterior wall is a first magnetic element 52 that will engage a second magnetic element 53 positioned on the interior back wall of the housing element 12. The magnets 52, 53 will provide a force used to compress the gasket 26 to the frontal face of the bin housing 12. The amount of mating magnetic material will determine the force necessary to remove the bin. Above each bin 14 is an exchangeable label housing 20 with an indication arrow 38 pointing to the appropriate bin 14.

Figure 7:
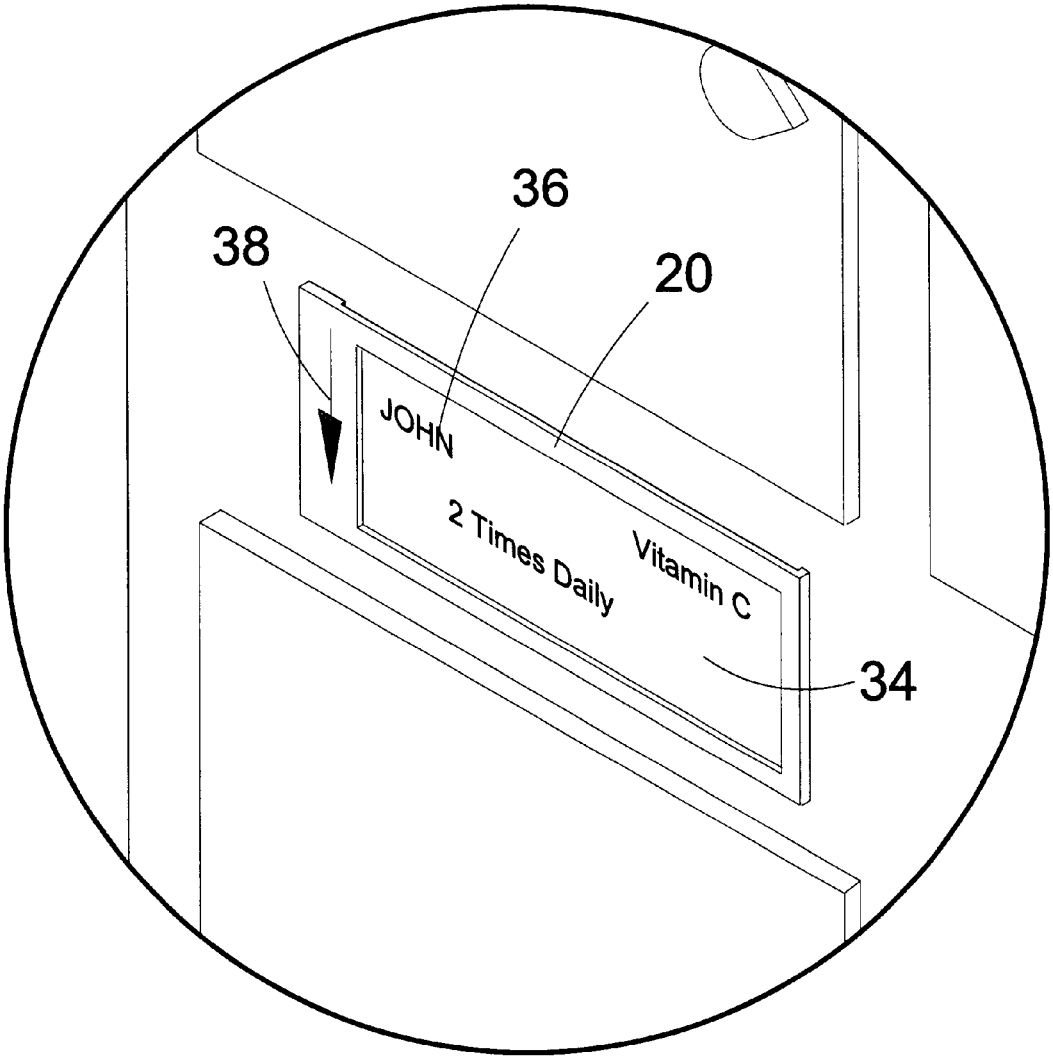
FIG. 7 is a detail view of the label housing of the present invention with label within label housing.
Figure 8:
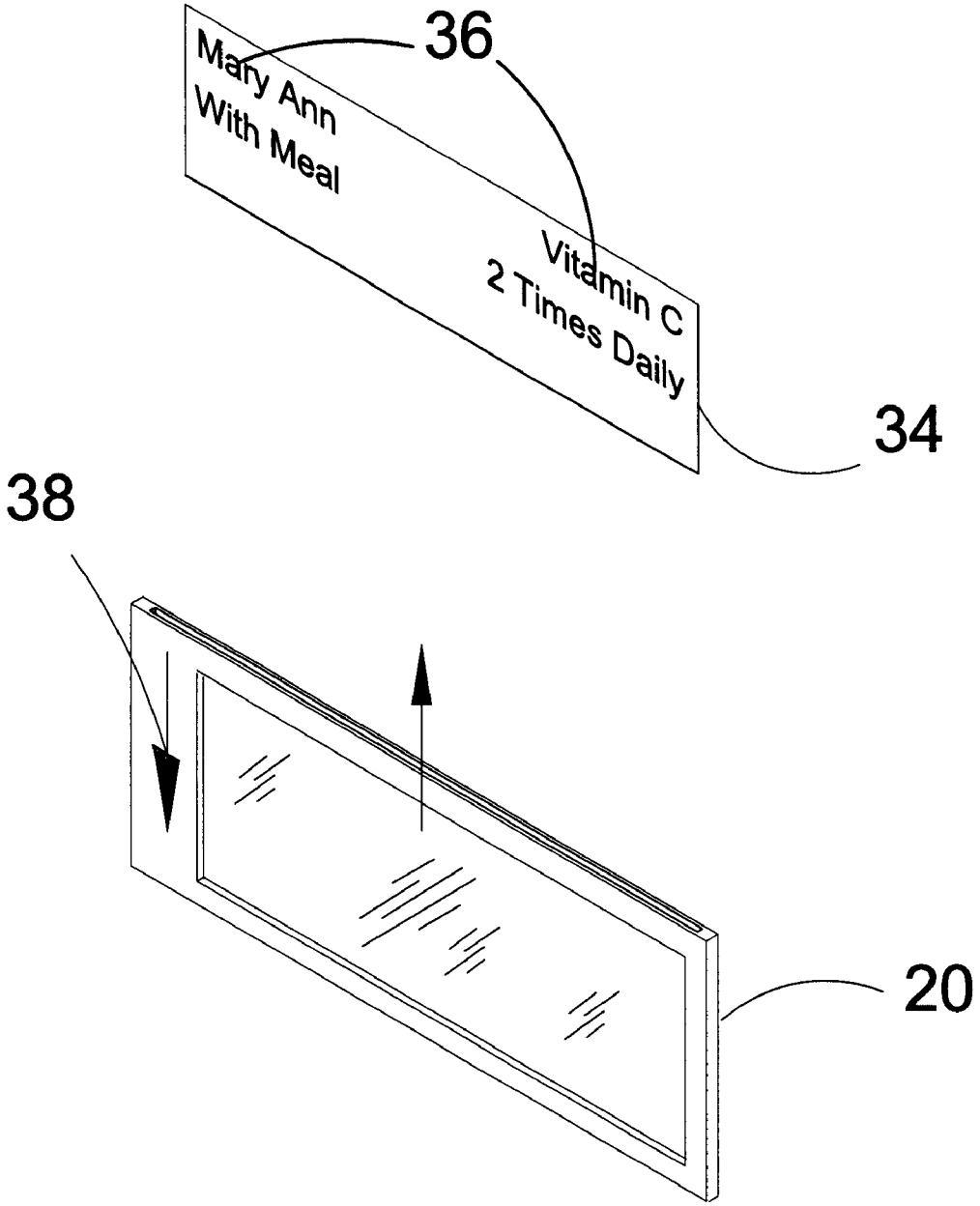
FIG. 8 is a detail view of the label housing with the label removed.

FIGS. 7 and 8 show the label housing 20 of the present invention 10. A label housing 20 is provided above each bin 14 and has an arrow pointing to the corresponding bin 14. A clear plastic protective plate and information label 34 are placed within the label housing 20.

Figure 9:
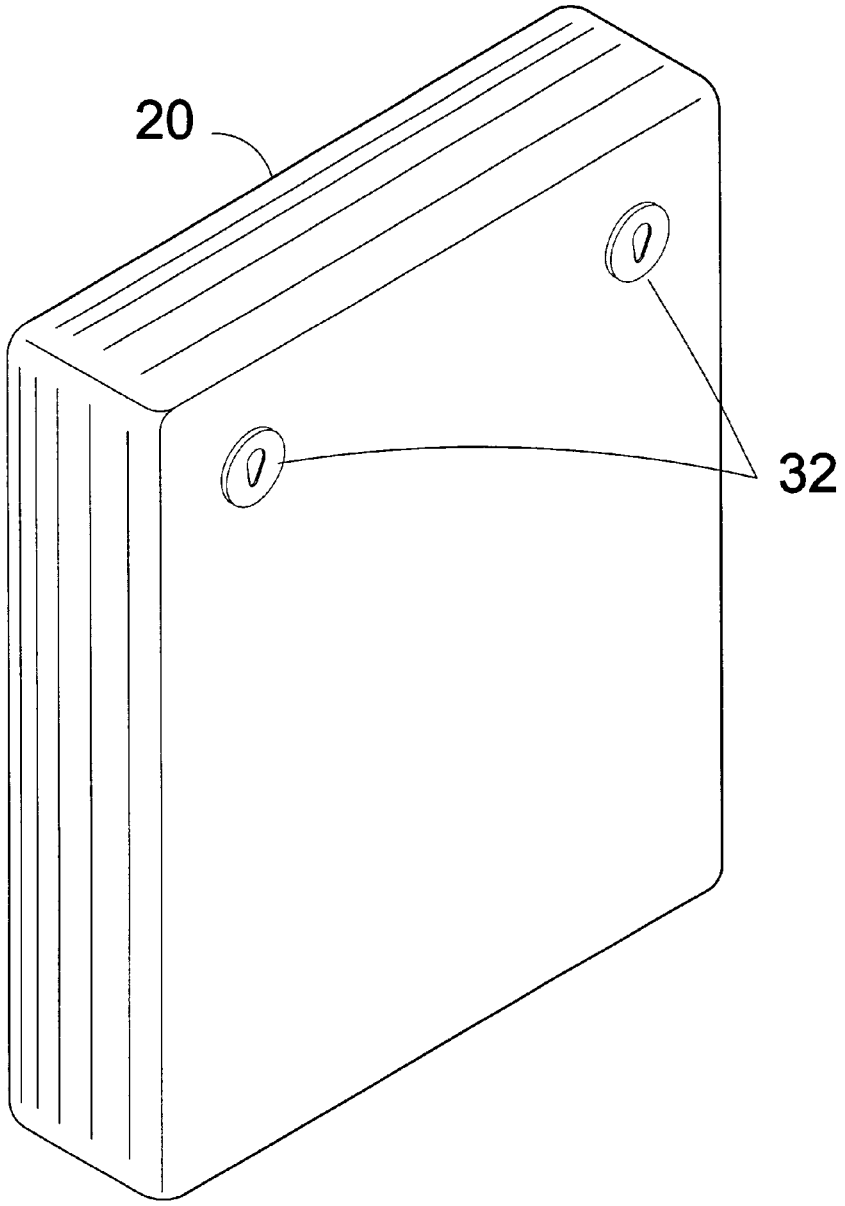
FIG. 9 is a rear view of the housing of the present invention.

FIG. 9 is a perspective rear view of the housing member 12. A wall so fastening means 32 is provided to accommodate a screw, molly or other wall fastening element. All units can stand or be wall mounted.

Figure 10:
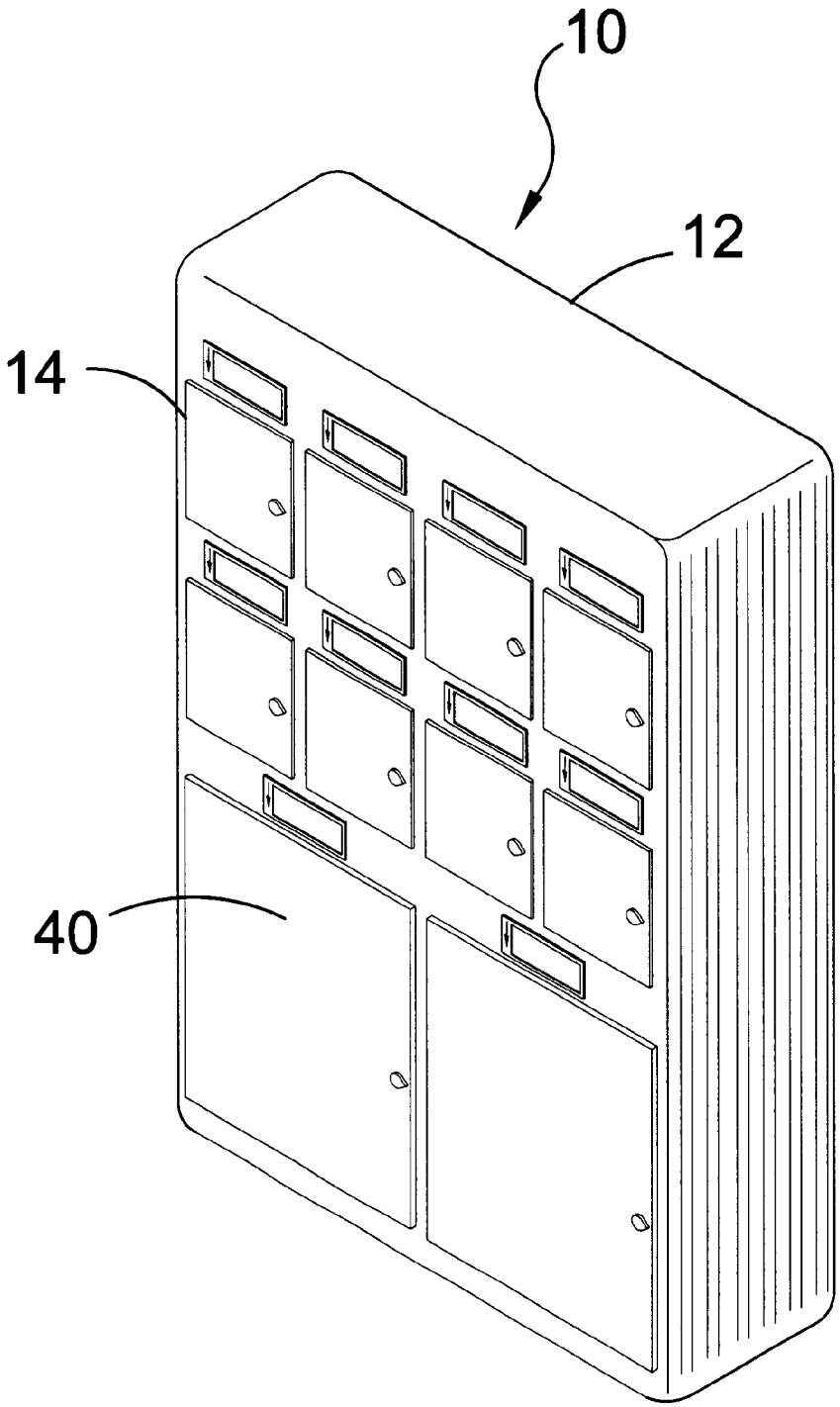
FIG. 10 is an alternate size and design of the housing of the present invention.

FIG. 10 shows the present invention 10 having large modular bins 40 maintained in the housing 12 with the other bins 14.

Figure 11:
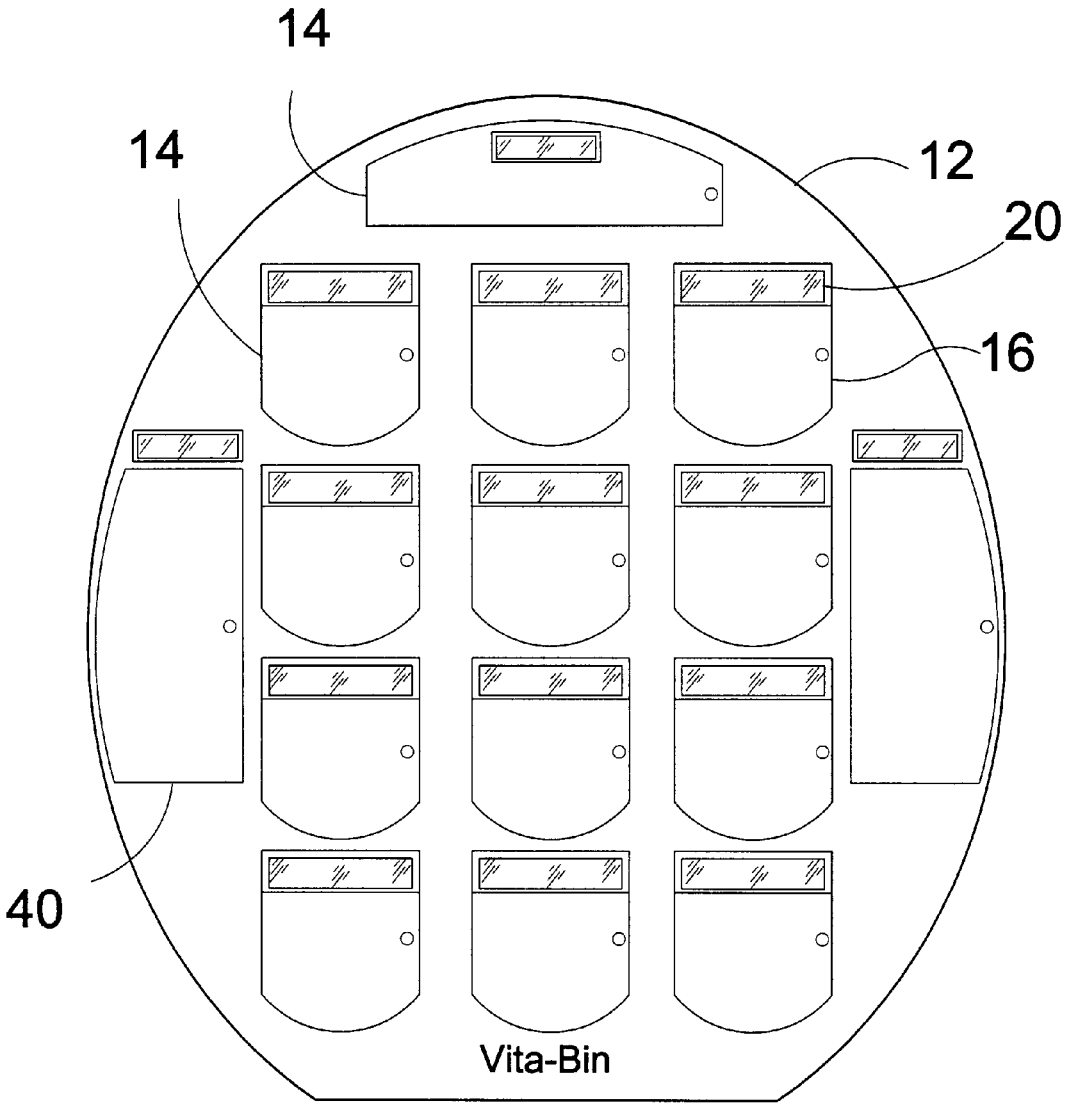
FIG. 11 is an alternate front view of the present invention.

FIG. 11 demonstrates that the housing 12 and the bins 14, 40 could come in different sizes, configurations as needed for different applications and aesthetics. The label housing 20 could also be mounted on the bin door 16.

Figure 12:
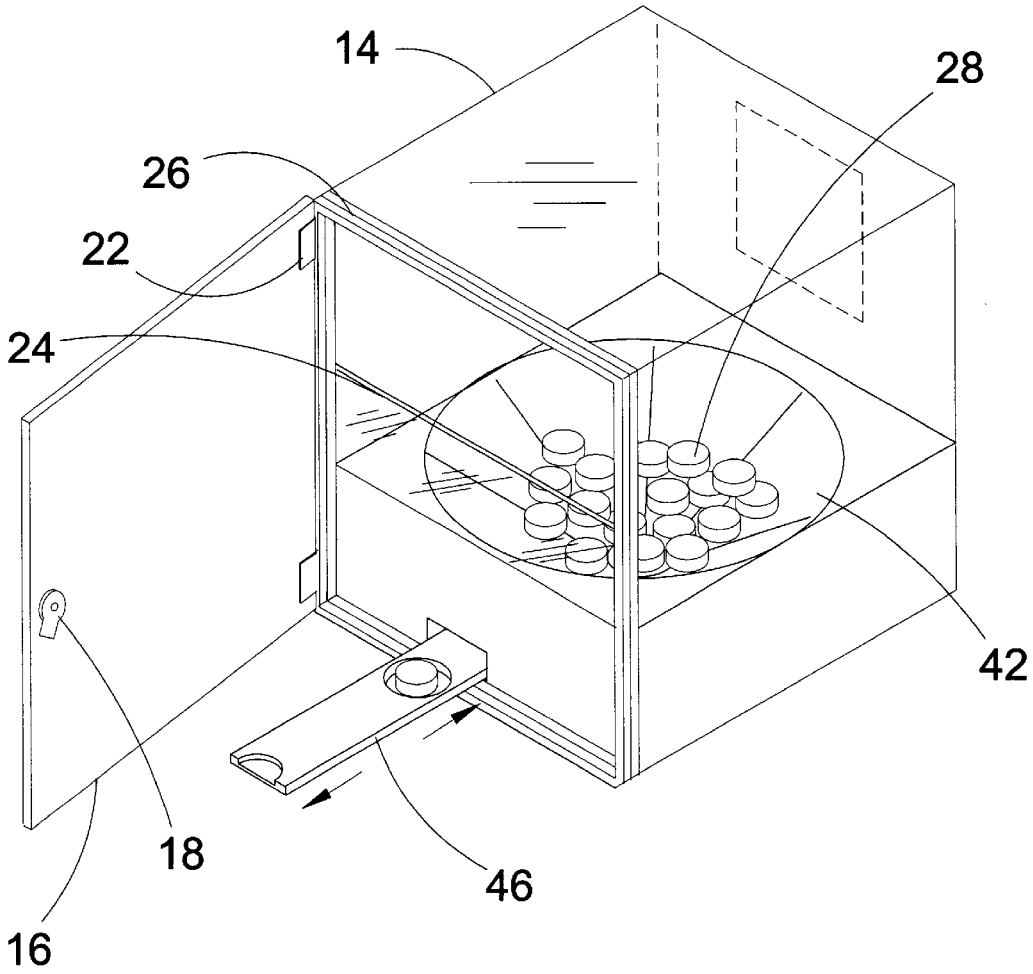
FIG. 12 is an alternate view of an individual compartment of the present invention.
Figure 13:
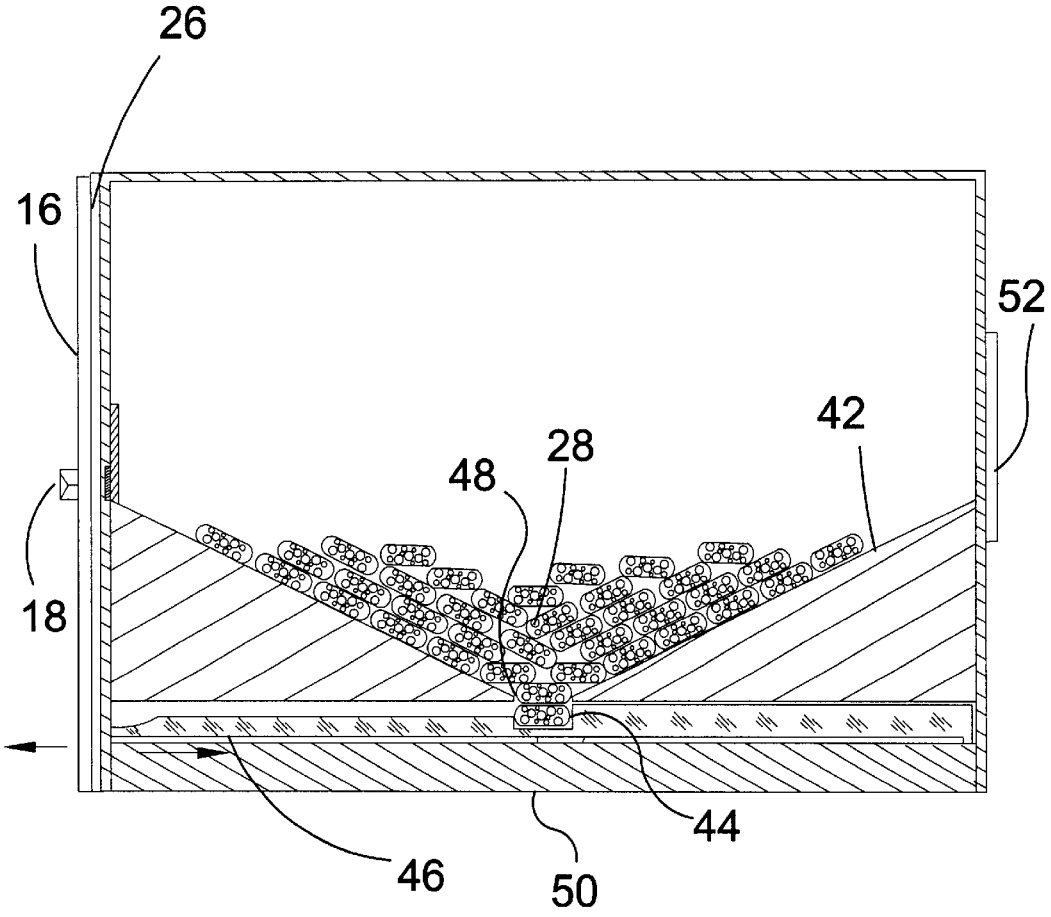
FIG. 13 is a sectional view of an alternate individual bin of the present invention.
Figure 14:
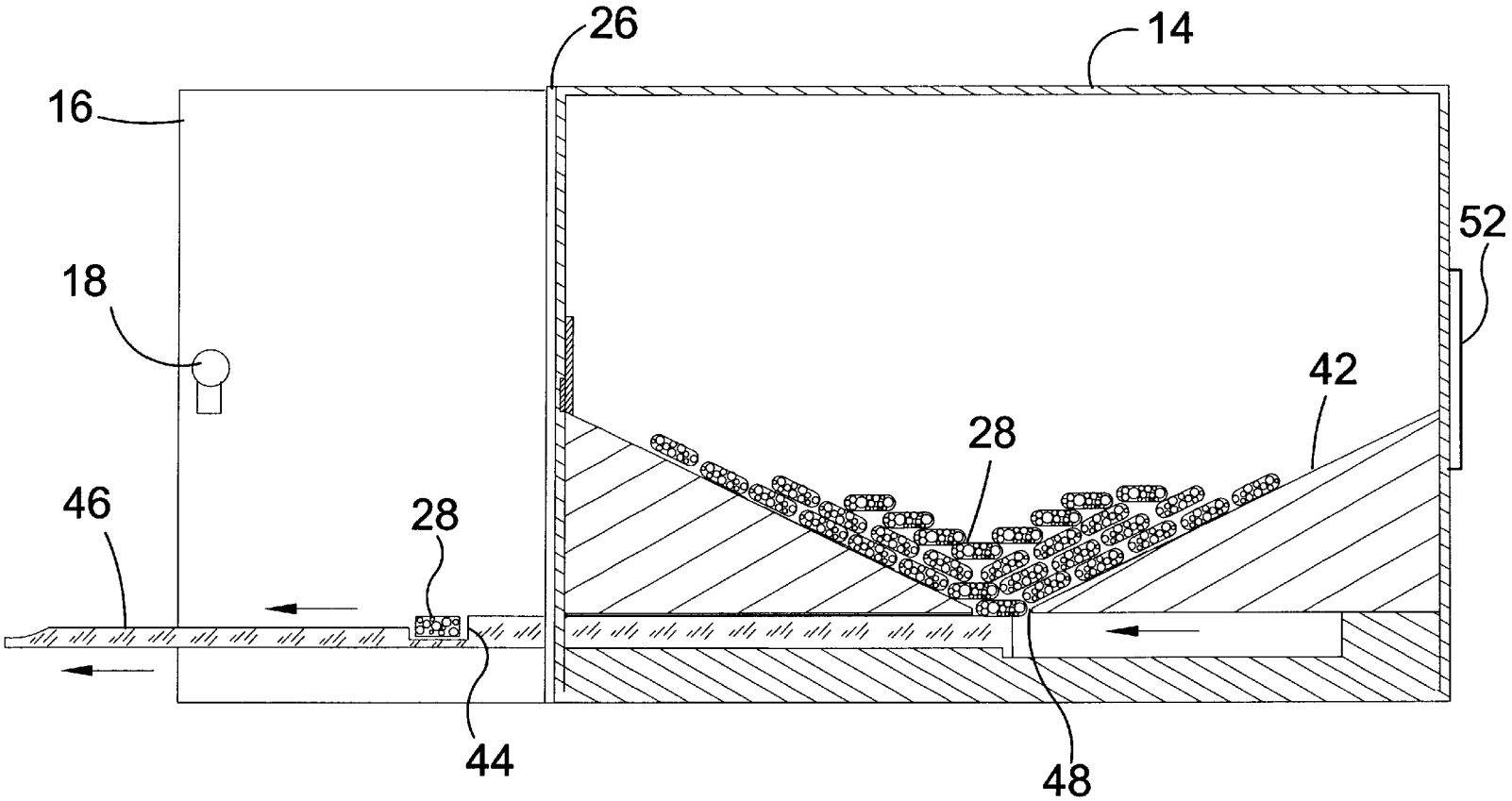
FIG. 14 is a sectional view of an alternate individual bin of the present invention.

FIGS. 12, 13 and 14 depict a bin having a tablet dispensing means. A funnel shaped dispensing plate 42 is inside the bin 14 above the bottom plate 50. When tablets or capsules are placed inside the bin 14 they are directed to the transfer recess 48 located centrally in the bottom of the funnel shaped dispensing plate 42. The first pill to reach the transfer recess 48 passes therethrough and falls into the tablet recess 40 aligned therebelow. The user slides the dispenser element outward until the vitamin 28 is accessible and removes it before sliding the dispensing element 46 back into place. When the transfer recess 48 is realigned with the tablet recess 44 the next available pill or tablet residing in the transfer recess 48 is deposited into the dispenser element recess 44.

Figure 15:
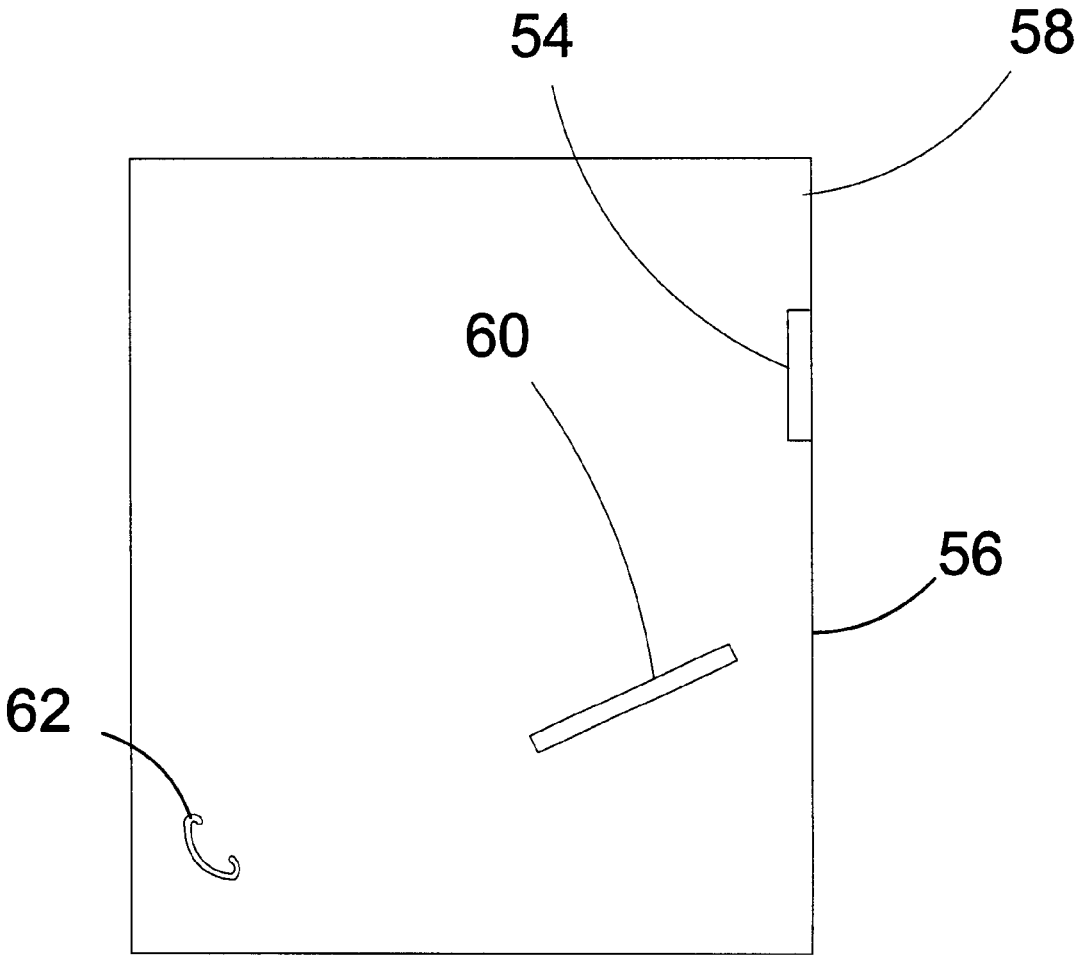
FIG. 15 is a side view of the tilt bin housing of the present invention.
Figure 16:
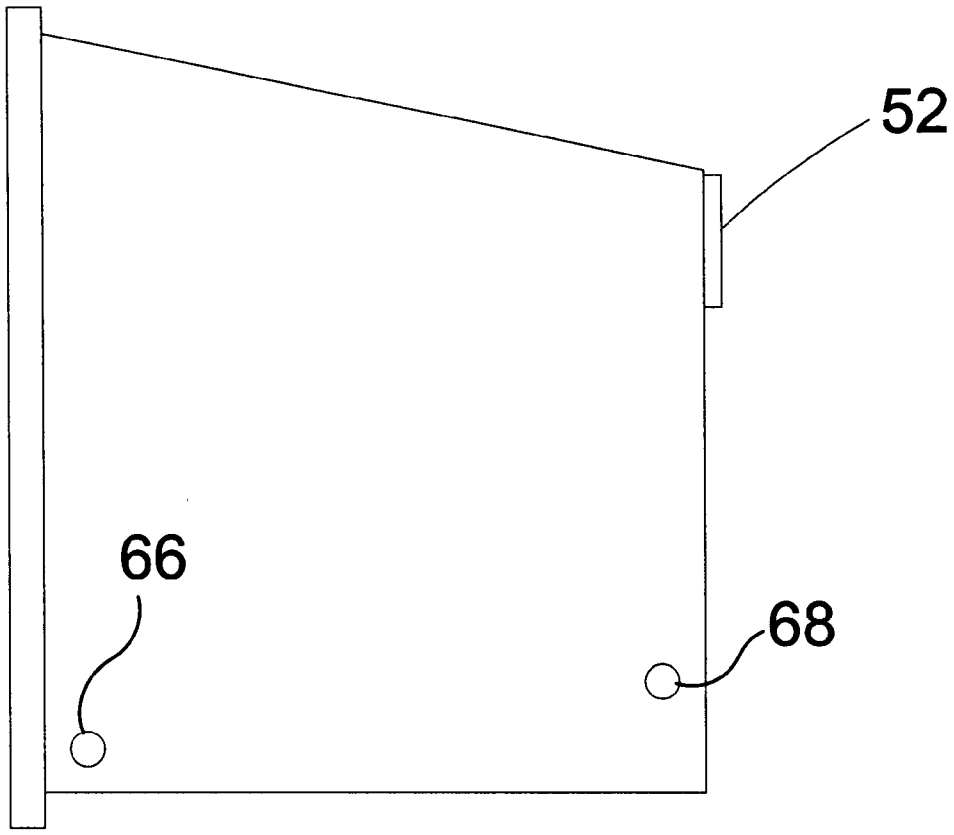
FIG. 16 is a side view of the tilt bin of the present invention.
Figure 17:
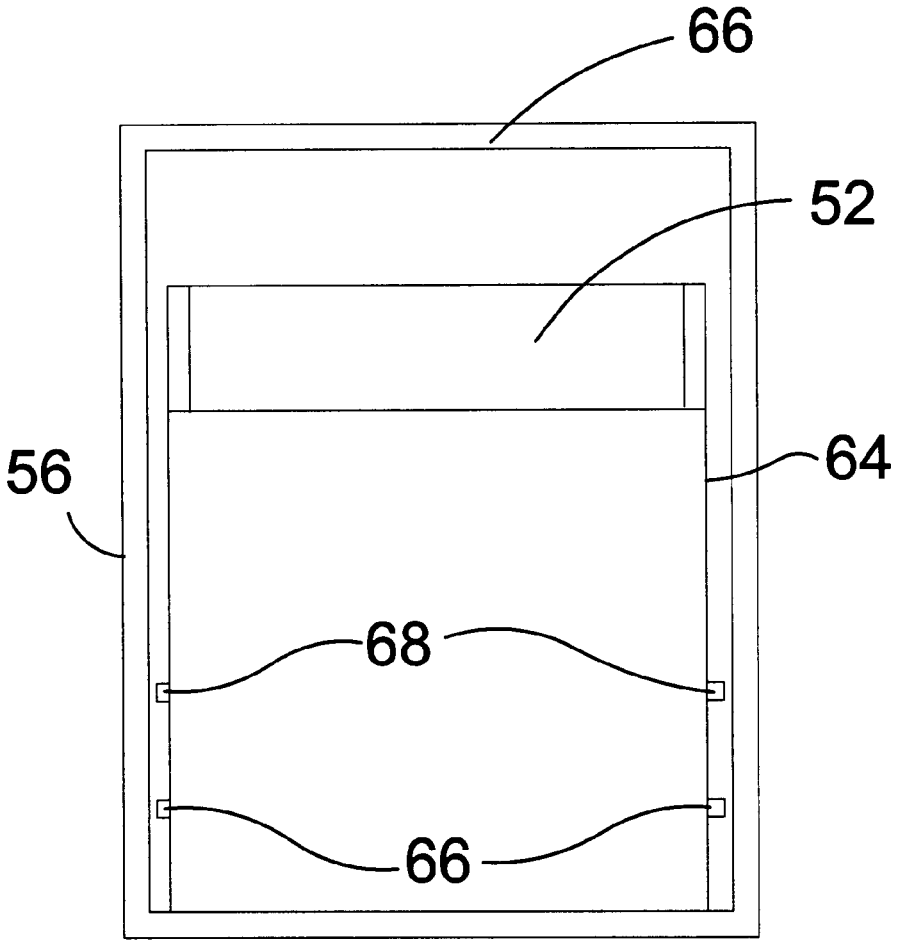
FIG. 17 is a rear view of the tilt bin within the tilt bin housing.

FIGS. 15, 16, and 17 show the present invention having a tilt bin 64 which pivots within a tilt bin housing 56 on pivot pins 66 that rotate within pivot pin retainers 62 with a stop pin 68 and stop member 60 to restrict the pivoting movement of the tilt bin 64 in such a manner as to promote easy access to the contents therein while prohibiting any spillage thereof.

Figure 18:
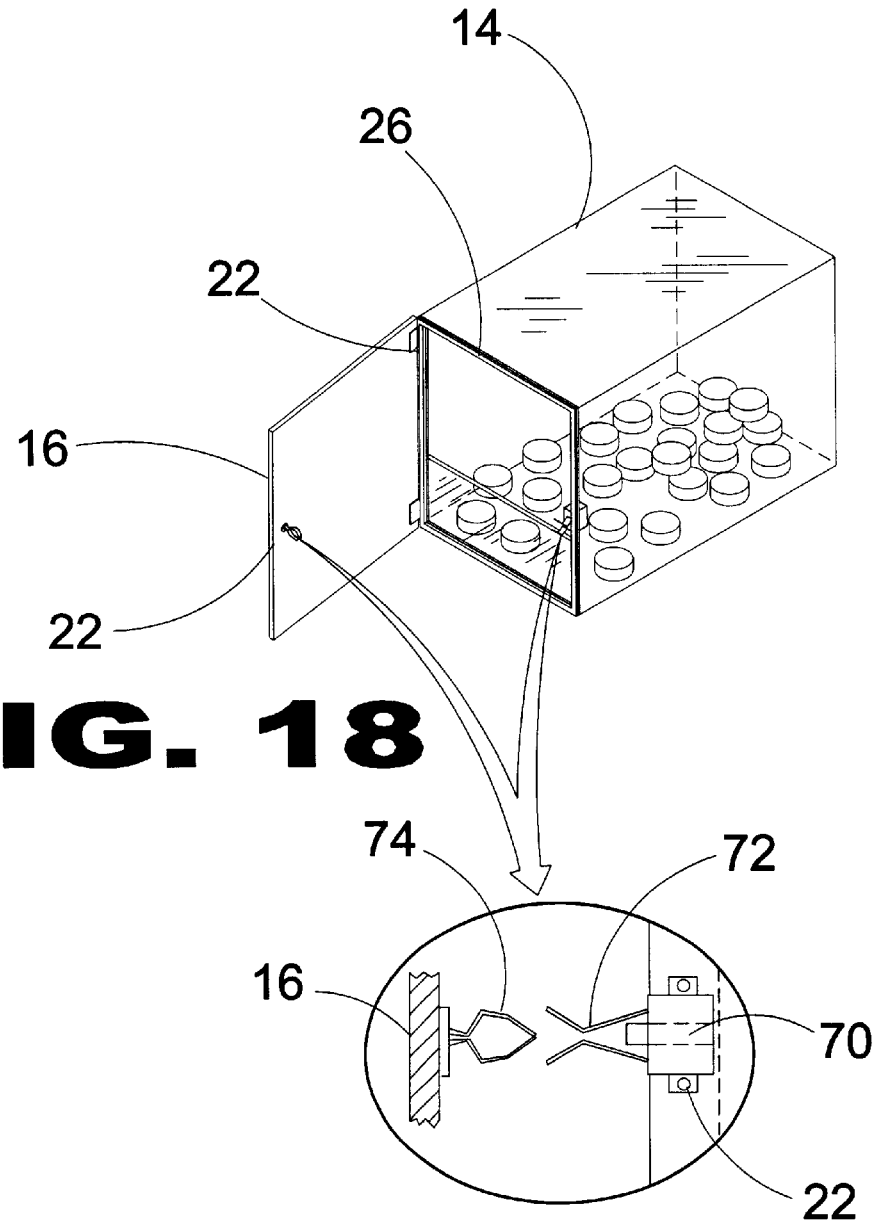
FIG. 18 is a perspective view of a spring type closure fastener.

FIG. 18 is a perspective view of a modular housing 14 having a pressure sensitive spring-type closure fastener having a door clip 74 on the door 16 and a mating pincer-like pressure sensitive clip 72 that retains said door clip therein 74 until such time that pressure applied to the outside of said door 16 causes the spring housing 70 to compress and to eject the door clip 74.

What is claimed is new and desired to be protected by Letters Patent is set forth in the appended claims:

1. A compartmented vitamin organizer, comprising:

a) a housing member having a plurality of recesses on a front surface thereof;

b) a plurality of bins having a bottom plate, a back plate, a top plate, two side plates and an open front closed by a pivoted access door, said bins sized and configured to be inserted into said plurality of recesses in said housing and each said bin further includes a retaining shield on a lower portion of the open front adjacent the access door when closed and preventing any contents from inadvertently being removed when the access door is open; and c) said retaining shield including a means for adjusting the height thereof to accommodate a greater or lesser amount of vitamins.

2. A compartmented vitamin organizer as recited in claim 1, in which each said housing recess has means for removably retaining said bin therein.

3. A compartmented vitamin organizer as recited in claim 2, in which said retaining means is a first magnet located on an exterior portion of said bin back plate and a second corresponding magnet on a rear wall of said housing recess.

4. A compartmented vitamin organizer as recited in claim 1, in which said housing member further includes a fastening means for mounting said housing member to a vertical structure.

5. A compartmented vitamin organizer as recited in claim 1, in which each said access door has a locking means for securing each said access door in a closed position.

6. A compartmented vitamin organizer as recited in claim 5, in which said locking means is a spring-loaded knob that allows a user to selectively secure and open said access door.

7. A compartmented vitamin organizer as recited in claim 1, in which each said bin has a sealing means to hermetically seal the inside of each said bin when said access door is closed.

8. A compartmented vitamin organizer as recited in claim 7, in which said sealing means is a gasket positioned at the contact points between said bin and said access door when in the closed position.

9. A compartmented vitamin organizer as recited in claim 1, in which said retaining shield height adjustment means includes a second retaining shield that slides within retaining grooves wherein a lower position is adjacent face to face and parallel to said retaining shield and a upper position is situated atop said retaining shield.

10. A compartmented vitamin organizer as recited in claim 1, in which each said bin has a means for permitting a user to observe any contents therein without opening the access door or while removing said contents therefrom.

11. A compartmented vitamin organizer as recited in claim 1, in which each said bin is comprised of a transparent material.

12. A compartmented vitamin organizer as recited in claim 1, in which each said bin has a respective labeling means on said housing to enable a user to readily identify the contents therein and provide any other pertinent information thereof.

13. A compartmented vitamin organizer as recited in claim 12, in which said labeling means comprises:

a) a transparent label housing member;

b) a label to be removably inserted into said label housing member; and c) indicia on said label.

14. A compartmented vitamin organizer as recited in claim 13, in which said indicia provides pertinent information regarding the contents of said bin.

15. A compartmented vitamin organizer as recited in claim 13, in which each said label housing member further includes a bin indication arrow to allow a user to match said indicia on said label with the corresponding bin.

* * * * *